US009102070B1

(12) United States Patent
Ho

(10) Patent No.: US 9,102,070 B1
(45) Date of Patent: Aug. 11, 2015

(54) BENDABLE AND SHAPE-RETAINING HAIR CUTTING APPARATUS

(71) Applicant: Lydia M. Ho, Troy, NY (US)

(72) Inventor: Lydia M. Ho, Troy, NY (US)

( * ) Notice: Subject to any disclaimer, the term of this patent is extended or adjusted under 35 U.S.C. 154(b) by 0 days.

(21) Appl. No.: 14/624,588

(22) Filed: Feb. 18, 2015

(51) Int. Cl.
*B26B 13/24* (2006.01)
*A45D 24/36* (2006.01)
*B26B 13/10* (2006.01)

(52) U.S. Cl.
CPC ..... *B26B 13/24* (2013.01); *A45D 24/36* (2013.01); *B26B 13/10* (2013.01)

(58) Field of Classification Search
CPC ..... A45D 24/36; B26B 13/24; B26B 21/12; B26B 19/06; B26B 19/42
USPC ..... 30/2, 30, DIG. 3, 111, 113, 118, 129, 30/134, 144, 198–201, 229, 278, 298, 294, 30/314, 315, 355–358; 132/144–145, 213, 132/213.1, 214, 129; 606/120, 157
See application file for complete search history.

(56) References Cited

U.S. PATENT DOCUMENTS

| | | | | | |
|---|---|---|---|---|---|
| 1,175,023 | A | * | 3/1916 | Szabo | 30/30 |
| 1,182,059 | A | * | 5/1916 | Tirevol | 30/30 |
| 1,678,891 | A | * | 7/1928 | Walsh | 132/118 |
| 2,171,503 | A | * | 8/1939 | Huppert | 132/145 |
| 2,532,921 | A | * | 12/1950 | Kashian | 30/233.5 |
| 2,991,553 | A | * | 7/1961 | Levine | 30/30 |
| 3,631,858 | A | * | 1/1972 | Ersek | 606/120 |
| 5,213,116 | A | * | 5/1993 | Stein | 132/213.1 |
| 5,427,122 | A | * | 6/1995 | Hamilton | 132/214 |
| 5,954,063 | A | * | 9/1999 | Pomaro | 132/213 |
| 5,954,064 | A | | 9/1999 | Motherhead | |
| 6,135,123 | A | | 10/2000 | Grassi et al. | |
| 6,267,119 | B1 | | 7/2001 | Silva | |
| 8,826,922 | B1 | | 9/2014 | Lewis | |
| 2005/0217687 | A1 | * | 10/2005 | Flanick | 132/214 |
| 2010/0275944 | A1 | | 11/2010 | Bandonis | |

* cited by examiner

*Primary Examiner* — Laura M Lee

(57) ABSTRACT

A bendable and shape-retaining hair cutting apparatus include two resilient clip members (10, 12) hingedly connected to each other, and two blades (22, 24) made of bendable and shape-retaining metal and mounted in the two clip members (10, 12). A button (36) is provided to push one blade (24) into slidable and shearing engagement with the other blade (22). The hair cutting apparatus can be bent into a desired shape and the button (36) is pushed once to cut hair clipped between the two clip members (10, 12) to thereby create a haircut of the desired shape.

20 Claims, 12 Drawing Sheets

BENDABLE AND SHAPE-RETAINING HAIR CUTTING APPARATUS

FIELD OF THE TECHNOLOGY

The present application relates to a bendable and shape-retaining hair cutting apparatus.

BACKGROUND

Cutting of hair usually involves the use of a comb and a pair of scissors. A user needs to use both hands to cut hair. One hand is used to hold the comb and run it down a section of the hair. When a desired length is reached, the user anchors the hair between the index and middle fingers and snips the ends sticking out of the fingers. This snipping action has to be repeated many times until the ends are uniform. This haircutting process is time consuming. The ends of the hair may not be uniformly cut, and the fingers may be injured by the sharp blades of the scissors. Also, stylish haircuts are difficult to create because the comb and the blades of the scissors are straight and not bendable.

There is a need to produce a bendable and shape-retaining hair cutting apparatus for creating stylish haircuts of various shapes and cutting hair quickly in one push of a button.

The above description of the background is provided to aid in understanding a hair cutting apparatus, but is not admitted to describe or constitute pertinent prior art to the hair cutting apparatus, or consider the cited documents as material to the patentability of the claims of the present application.

SUMMARY

According to one aspect, there is provided a bendable and shape-retaining hair cutting apparatus including:

first and second resilient clip members hingedly connected to each other, and provided with oppositely facing first and second grooves formed on opposite inner sides of the first and second clip members respectively;

a first blade fixedly mounted in the first groove;

a second blade moveably mounted in the second groove, and adapted to be inserted into the first groove and entered into slidable and shearing engagement with the first blade, the first and second blades being made of bendable and shape-retaining metal or alloy;

a push plate extending transversely from an inner lateral side of the second blade and passing through a transverse bore formed on an outer side of the second clip member, a free end of the push plate being protruded from the outer side of the second clip member;

a push button fixed at the free end of the push plate;

a spring mounted on the push plate between the second blade and the push button for biasing the second blade in a retracted position inside the second groove;

a hinge connecting a hinged end of the first clip member with a hinged end of the second clip member; and a fastener adapted to fasten an opposite free end of the first clip member to an opposite free end of the second clip member;

wherein the first and second clip members together with the first and second blades provided therein are adapted to be bent into a plurality of desired shapes; and when the push button is pushed against the spring, the second blade moves laterally towards the first blade and enters into slidable and shearing engagement therewith, thereby cutting hair clipped between the first and second clip members and creating a plurality of haircuts of the desired shapes;

wherein the hinge includes:

first and second pins inserted into first and second pin holes formed on the hinged ends of the first and second clip members respectively, enlarged heads being provided on upper and lower ends of each pin for securely holding the first and second pins in the first and second pin holes;

a top hinge member formed with first and second openings mounted on the upper ends of the first and second pins respectively, and secured thereto by the enlarged heads; and a bottom hinge member formed with first and second openings mounted on the lower ends of the first and second pins respectively, and secured thereto by the enlarged heads;

wherein the fastener includes:

a U-shaped strap having a U-shaped body and two ends, each end being formed with an opening; and a third pin inserted into a third pin hole formed on the opposite free end of the first clip member, the two openings of the two ends of the U-shaped strap being mounted on upper and lower ends of the third pin and secured thereto by two enlarged heads formed thereon respectively;

wherein the U-shaped body is adapted to be swung about the third pin and wrapped around the opposite free end of the second clip member to thereby fasten the first and second clip members side-by-side together.

In one embodiment, the second blade may be in the form of a toothed blade with a plurality of teeth adapted to be inserted into the first groove and entered into slidable and shearing engagement with the first blade when the first and second clip members are fastened together. At least one of the two opposite inner sides of the first and second clip members may have a corrugated surface.

The bendable and shape-retaining metal or alloy may be copper, copper alloy, aluminum, aluminum alloy, or combinations thereof, or any other suitable metal or alloy. The first and second clip members may be made of a shape-retaining plastic material selected from the group consisting of polyethylene, polyurethane, polystyrene, and a combination thereof.

According to another aspect, there is provided a bendable and shape-retaining hair cutting apparatus including:

first and second resilient clip members hingedly connected to each other, and provided with oppositely facing first and second grooves formed on opposite inner sides of the first and second clip members respectively;

a first blade fixedly mounted in the first groove;

a second blade moveably mounted in the second groove, and adapted to be inserted into the first groove and entered into slidable and shearing engagement with the first blade, the first and second blades being made of bendable and shape-retaining metal;

a push plate extending transversely from an inner lateral side of the second blade and passing through a transverse bore formed on an outer side of the second clip member, a free end of the push plate being protruded from the outer side of the second clip member;

a push button fixed at the free end of the push plate; and a spring mounted on the push plate between the second blade and the push button for biasing the second blade in a retracted position inside the second groove;

wherein the first and second clip members together with the first and second blades provided therein are adapted to be bent into a plurality of desired shapes; and when the push button is pushed against the spring, the second blade moves laterally towards the first blade and enters into slidable and shearing engagement therewith, thereby cutting hair clipped between the first and second clip members and creating a plurality of haircuts of the desired shapes.

A hinged end of the first clip member can be hingedly connected with a hinged end of the second clip member by a hinge, and an opposite free end of the first clip member is adapted to be fastened to an opposite free end of the second clip member by a fastener.

In one embodiment, the second blade is in the form of a toothed blade with a plurality of teeth adapted to be inserted into the first groove and entered into slidable and shearing engagement with the first blade when the first and second clip members are fastened together. At least one of the two opposite inner sides of the first and second clip members is a corrugated surface.

The bendable and shape-retaining metal or alloy may be copper, copper alloy, aluminum, aluminum alloy, or combinations thereof, or any other suitable metal or alloy. The first and second clip members may be made of a shape-retaining plastic material selected from the group consisting of polyethylene, polyurethane, polystyrene, and a combination thereof.

In one embodiment, the hinge may include:

first and second pins inserted into first and second pin holes formed on the hinged ends of the first and second clip members respectively, enlarged heads being provided on upper and lower ends of each pin for securely holding the first and second pins in the first and second pin holes;

a top hinge member formed with first and second openings mounted on the upper ends of the first and second pins respectively, and secured thereto by the enlarged heads; and a bottom hinge member formed with first and second openings mounted on the lower ends of the first and second pins respectively, and secured thereto by the enlarged heads.

In one embodiment, the fastener may include:

a U-shaped strap having a U-shaped body and two ends, each end being formed with an opening; and a third pin inserted into a third pin hole formed on the opposite free end of the first clip member, the two openings of the two ends of the U-shaped strap being mounted on upper and lower ends of the third pin and secured thereto by two enlarged heads formed thereon respectively;

wherein the U-shaped body is adapted to be swung about the third pin and wrapped around the opposite free end of the second clip member to thereby fasten the first and second clip members side-by-side together.

In one embodiment, one of the desired shapes is a straight shape for producing a straight haircut.

In one embodiment, one of the desired shapes is an upwardly curved shape for producing an upwardly curved haircut.

In one embodiment, one of the desired shapes is a downwardly curved shape for producing a downwardly curved haircut.

In one embodiment, one of the desired shapes is a generally U-shape for producing a generally U-shaped haircut.

In one embodiment, one of the desired shapes is a V-shape for producing a V-shaped haircut.

In one embodiment, one of the desired shapes is a wavy shape for producing a wavy haircut.

In one embodiment, the apparatus may include:

two push plates extending transversely from the inner lateral side of the second blade and passing through two transverse bores formed on the outer side of the second clip member respectively, a free end of each push plate being protruded from the outer side of the second clip member;

two push buttons fixed at the free ends of the two push plates respectively; and two springs mounted on the two push plates between the second blade and the two push buttons respectively for biasing the second blade in the retracted position inside the second groove.

Although the hair cutting apparatus is shown and described with respect to certain embodiments, it is obvious that equivalents and modifications will occur to others skilled in the art upon the reading and understanding of the specification. The hair cutting apparatus in the present application includes all such equivalents and modifications, and is limited only by the scope of the claims.

BRIEF DESCRIPTION OF THE DRAWINGS

Specific embodiments of the hair cutting apparatus will now be described by way of example with reference to the accompanying drawings wherein:

FIG. 6(*b*) is a perspective view of the bendable and shape-retaining hair cutting apparatus bent into an upwardly curved shape.

FIG. 6(*c*) is a perspective view of the bendable and shape-retaining hair cutting apparatus with one clip member being flipped out and hair to be cut being positioned between the two clip members.

FIG. 6(*d*) is a perspective view of the bendable and shape-retaining hair cutting apparatus showing one clip member being flipped back into a closed position with the hair to be cut clipped between the two clip members.

FIG. 6(*e*) is a perspective view of the bendable and shape-retaining hair cutting apparatus showing the hair cut by the blades.

FIG. 6(*f*) illustrates an upwardly curved haircut of the hair.

FIG. 13(*a*) is a perspective view of the two blades of the bendable and shape-retaining hair cutting apparatus being bent into a wavy shape.

FIG. 14(*a*) is a perspective view of the two blades of the bendable and shape-retaining hair cutting apparatus being bent into a downwardly curved shape.

FIG. 15(*a*) is a perspective view of the two blades of the bendable and shape-retaining hair cutting apparatus being bent into a generally U-shape.

FIG. 16(*a*) is a perspective view of the two blades of the bendable and shape-retaining hair cutting apparatus being bent into a V-shape.

DETAILED DESCRIPTION

Figure 1:
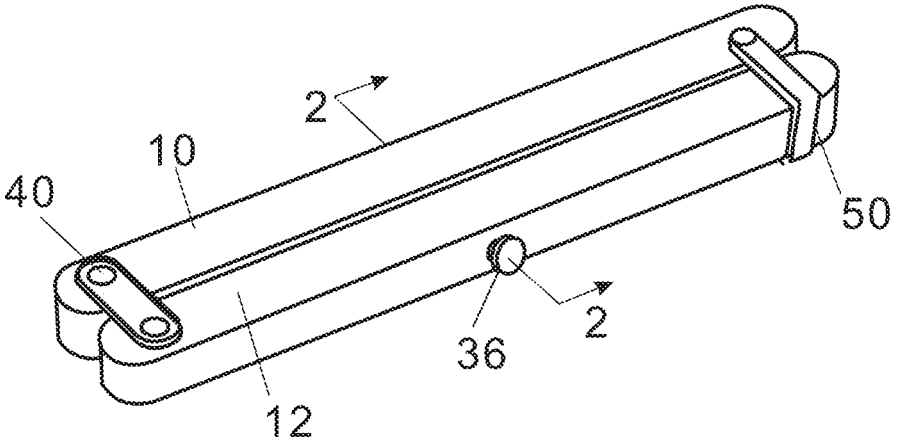
FIG. 1 is a perspective view of an embodiment of a bendable and shape-retaining hair cutting apparatus.

Reference will now be made in detail to a preferred embodiment of the hair cutting apparatus, examples of which are also provided in the following description. Exemplary embodiments of the hair cutting apparatus are described in detail, although it will be apparent to those skilled in the relevant art that some features that are not particularly important to an understanding of the hair cutting apparatus may not be shown for the sake of clarity.

Furthermore, it should be understood that the hair cutting apparatus is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure and appended claims.

For illustration purposes, the terms "upper", "lower", "upward". "downward", "top", "bottom" appeared hereinafter relate to the invention as it is oriented in the drawings. It is understood that the invention may assume various positions, except where expressly specified to the contrary. Furthermore, it is understood that the specific devices shown in the drawings, and described in the following description, are simply exemplary embodiments of the invention. Hence, specific dimensions and other physical characteristics related to the embodiments disclosed hereinafter are not to be considered as limiting.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element or is in mechanical or electrical communication with another element.

Further, the terms "first", "second", etc. are merely used to differentiate features to be described, and are not meant to indicate or imply the relative importance of the features.

Figure 2:
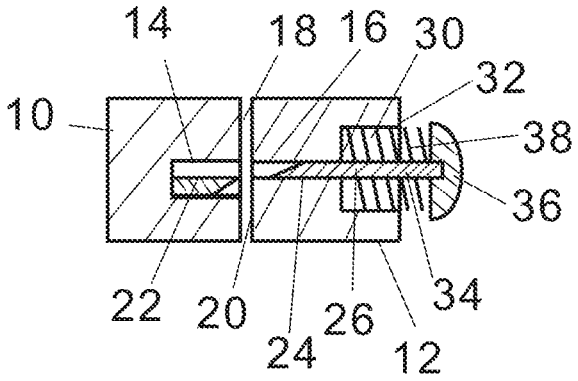
FIG. 2 is a cross sectional view taken along line 2-2 of the bendable and shape-retaining hair cutting apparatus of FIG. 1.
Figure 3:
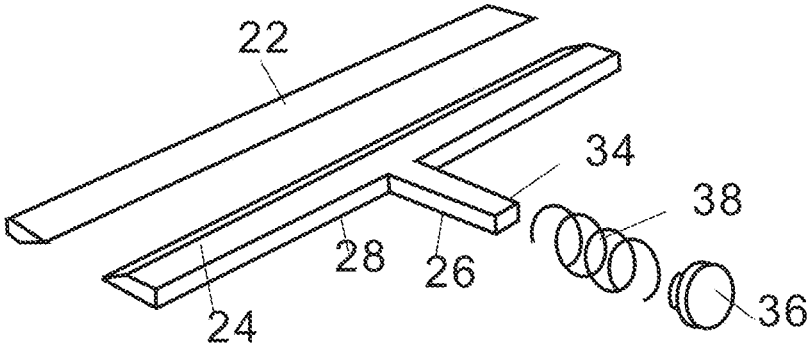
FIG. 3 is a perspective view of the two blades of the bendable and shape-retaining hair cutting apparatus of FIG. 2.

FIGS. 1, 2 and 3 show an embodiment of a bendable and shape-retaining hair cutting apparatus. As used herein, the term "bendable" means (a long object) capable of being turned or bent by force from a straight form into a curved or angular form, as well as from a curved or angular form into some other form or back into the straight form. Similarly, as used herein, the term "bend" means turning (a long object) by force from a straight form into a curved or angular form, as well as from a curved or angular form into some other form or back into the straight form. As used herein, the term "shape-retaining" means (a long object) being able to hold its shape when bent and does not bounce back to its original position. And, as used herein, the term "bendable and shape-retaining metal or alloy" means a metal or alloy having bendable and shape-retaining characteristics so that when a long object is made of such metal or alloy, the long object can be bent and held in the bent shape without bouncing back to its original position.

The bendable and shape-retaining hair cutting apparatus may include first and second resilient clip members 10, 12 disposed side-by-side and provided with oppositely facing first and second grooves 14, 16 formed on opposite inner sides 18, 20 of the first and second resilient clip members 10, 12 respectively. The first and second resilient clip members 10, 12 may be made of shape-retaining plastic that can retain their shapes when bent. The shape-retaining plastic may be polyethylene, polyurethane, polystyrene, or combinations thereof, or any other appropriate material.

A hinged end of the first clip member 10 may be hingedly connected with a hinged end of the second clip member 12 by a hinge 40, and an opposite free end of the first clip member 10 can be fastened to an opposite free end of the second clip member 12 by a fastener 50.

The bendable and shape-retaining hair cutting apparatus may include a first blade 22 and a second blade 24. The first blade 22 can be fixedly mounted in the first groove 14 by adhesive material, fasteners or any other suitable means. The second blade 24 can be moveably mounted in the second groove 16, and adapted to be inserted into the first groove 14 and driven into a slidable and shearing engagement with the first blade 18. The first and second blades 22, 24 may be made of bendable and shape-retaining metal or alloy such as copper, copper alloy, aluminum, aluminum alloy, or combinations thereof, or any other suitable metal or alloy. When the first and second blades 22, 24 are made of bendable and shape-retaining metal such as copper, the first and second blades 22, 24 can be bent in an upward or downward direction from a plane on which the first and second blades 22, 24 lie into a desired shape, and retained into the desired shape. Both or one of the first and second blades 22, 24 may have a sharpened cutting edge.

At least one push plate 26 may extend transversely from an inner lateral side 28 of the second blade 24 and through a transverse bore 30 formed on an outer side 32 of the second clip member 24. A free end 34 of the push plate 36 may protrude outwardly from the outer side 32 of the second clip member 12. A push button 36 may be fixed at the free end 34 of the push plate 26.

A spring 38 may be mounted on the push plate 26 between the second blade 24 and the push button 36 for biasing the second blade 34 in a retracted position inside the second groove 16.

The first and second clip members 10, 12 together with the first and second blades 22, 24 provided therein can be bent into a plurality of desired shapes. When the push button 36 is pushed against the spring 38, the second blade 24 moves laterally towards the first blade 22 and enters into slidable and shearing engagement with the first blade 22, thereby cutting hair clipped between the first and second clip members 10, 12 to create a plurality of haircuts of the desired shapes. The push button 36 can return to its original retracted position inside the second groove 16 under the influence of the biasing force of the spring 38 when the push button 36 is released after cutting.

Figure 4:
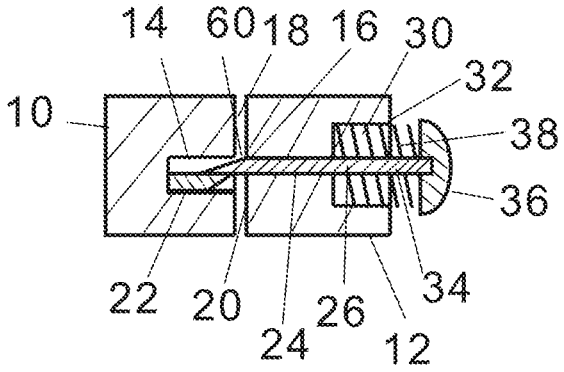
FIG. 4 is a cross sectional view similar to FIG. 2 showing one blade in slidable engagement with the other blade of the bendable and shape-retaining hair cutting apparatus according to another embodiment thereof.
Figure 5:
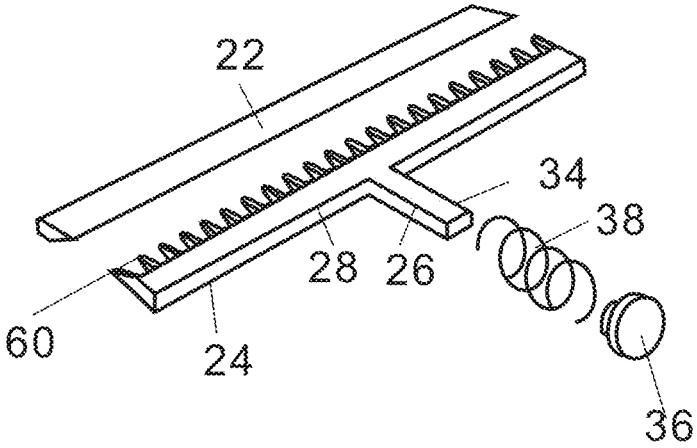
FIG. 5 is a perspective view of the two blades of the bendable and shape-retaining hair cutting apparatus of the embodiment in FIG. 4.
Figure 6A:
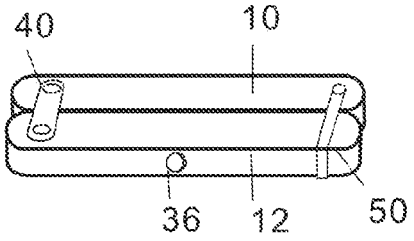
FIG. 6(*a*) is a perspective view of the bendable and shape-retaining hair cutting apparatus in a straight form.
Figure 6B:
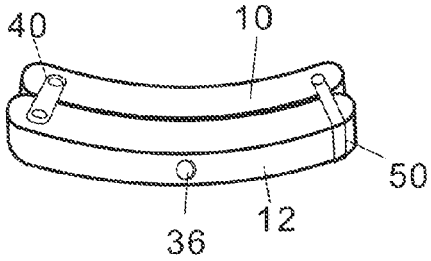
Figure 6C:
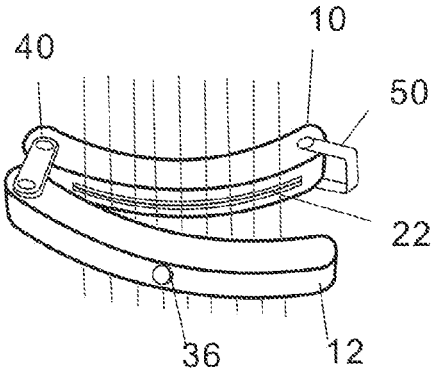
Figure 6D:
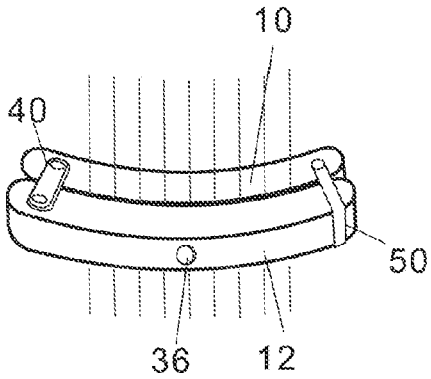
Figure 6E:
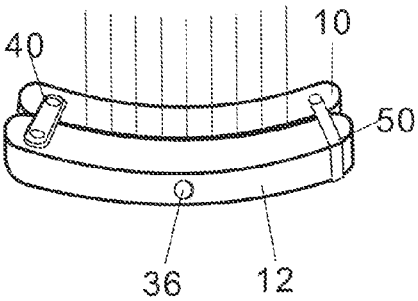
Figure 6F:
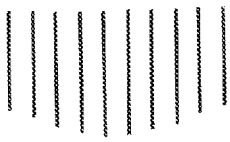
Figure 7A:
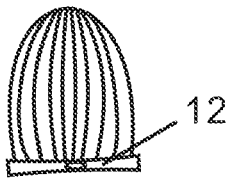
FIGS. 7(*a*)-7(*l*) show the creation of haircuts of various shapes using the bendable and shape-retaining hair cutting apparatus of the present application.
Figure 7B:
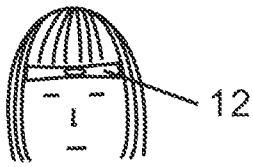
Figure 7D:
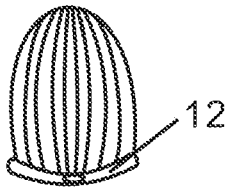
Figure 7D:
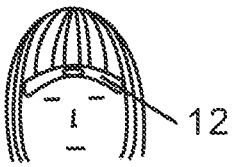
Figure 7E:
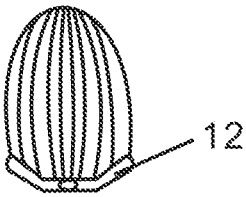
Figure 7F:
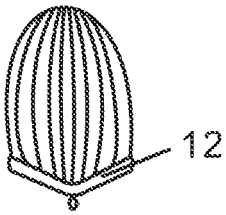
Figure 7G:
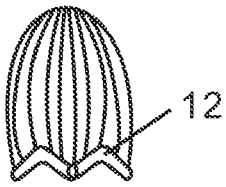
Figure 7H:
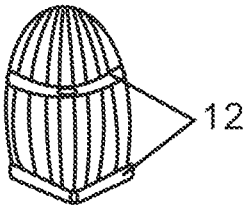
Figure 7J:
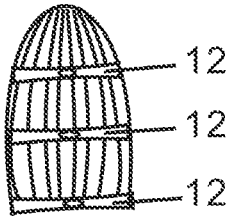
Figure 7J:
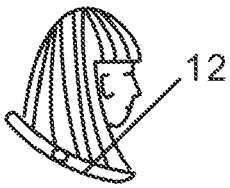
Figure 7K:
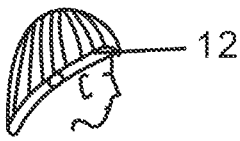
Figure 7L:
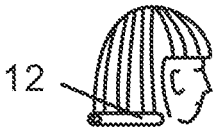

FIGS. 4 and 5 show another embodiment of the two blades of the bendable and shape-retaining hair cutting apparatus. In the illustrated embodiment, the second blade 24 may be in the form of a toothed blade formed with a plurality of teeth 60 adapted to be inserted into the first groove 14 and slidably engaged with the first blade 14 when the first and second clip members 10, 12 are clipped together.

The method for creating stylish haircuts of various shapes and cutting hair in one push of a button using the bendable and shape-retaining hair cutting apparatus of the present application is shown in FIGS. 6(*a*) to 6(*f*).

To cut hair, a user first holds or fastens the first and second clip members 10, 12 side-by-side together, as shown in FIG. 6(*a*).

The user then bends the first and second clip members 10, 12 together with the first and second blades 22, 24 provided therein into a desired shape, as shown in FIG. 6(*b*). In this example, the desired shape is an upwardly curved shape.

The user then flips out the second clip member 12 and positions hair to be cut between the first and second clip members 10, 12, as shown in FIG. 6(*c*).

The second clip member 12 is then flipped back to the side-by-side closed position thereby clipping the hair to be cut between the first and second clip members 10, 12, as shown in FIG. 6(*d*).

Finally, the user pushes the push button 36 once so that the second blade 24 is moved laterally towards the first blade 22 and entered into slidable and shearing engagement therewith, thereby cutting hair clipped between the first and second clip members, as shown in FIG. 6(*e*).

An upwardly curved haircut is then created, as shown in FIG. 6(*f*).

FIG. 7(*a*)-7(*j*) show the creation of haircuts of various shapes using the bendable and shape-retaining hair cutting apparatus of the present application. FIG. 7(*a*) shows a "straight cut" of the hair at the back a head. FIG. 7(*b*) shows a "straight bangs cut" of the hair above the forehead. FIG. 7(*c*) shows an "upwardly curved cut" of the hair at the back of a head. FIG. 7(*d*) shows a "downwardly curved bangs cut" of the hair above the forehead. FIG. 7(*e*) shows a "U-shaped cut" of the hair at the nape area at the back of a head. FIG. 7(*f*) shows a "V-shaped cut" of the hair at the back of a head. FIG. 7(*g*) shows a "wavy cut" of the hair at the back of a head.

Two or more bendable and shape-retaining hair cutter apparatuses can be used at the same time to create two or more layers of hair of different lengths and/or different shapes, as shown in FIGS. 7(*h*) and (*i*). As shown in FIG. 7(*h*), a user can cut hair at two different lengths of the hair using two bendable and shape-retaining hair cutting apparatuses bent into two different shapes respectively, thereby creating two layers of hair having two different shapes. As shown in FIG. 7(*i*), a user can cut hair at three different lengths of the hair using three bendable and shape-retaining hair cutting apparatuses respectively, thereby creating three layers of hair having different lengths.

The bendable and shape-retaining hair cutting apparatus may also be used to produce some popular haircuts, such as "long bob cut" shown in FIG. 7(*j*), "pageboy cut" shown in FIG. 7(*k*), and "blunt cut" shown in FIG. 7(*l*).

Figure 8:
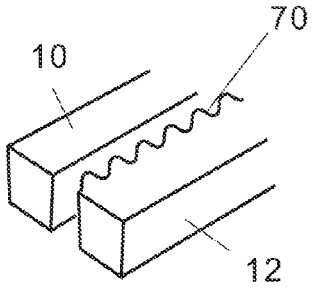
FIG. 8 is a fragmentary view of the clip members showing a corrugated surface formed on an inner side of one of the clip members.

FIG. 8 is a fragmentary view of the first and second clip members 10, 12 showing a corrugated surface 70 formed on the inner side 20 of the second clip member 12. The corrugated surface 70 can be used to provide a space between the first and second clip members 10, 12 for receiving and holding thereinbetween hair to be cut.

Figure 9:
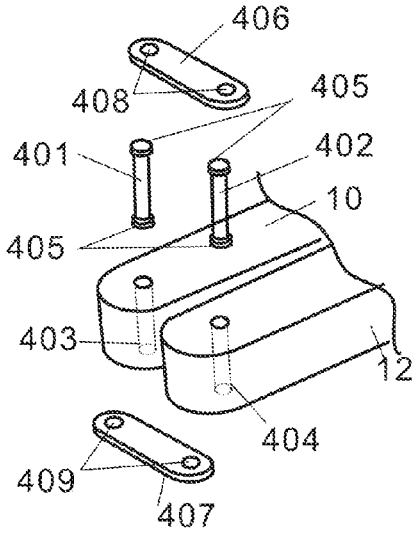
FIG. 9 is a fragmentary view of an embodiment of a hinge of the bendable and shape-retaining hair cutting apparatus.
Figure 10:
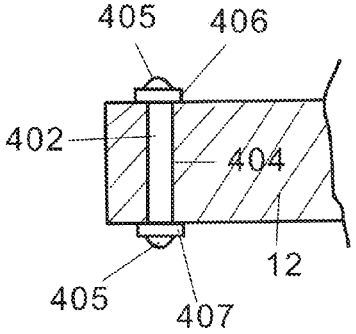
FIG. 10 is a cross sectional view of the hinge of the bendable and shape-retaining hair cutting apparatus in FIG. 9.

FIGS. 9 and 10 show an embodiment of the hinge 40 of the bendable and shape-retaining hair cutting apparatus. The hinge 40 may include first and second pins 401, 402 inserted into first and second pin holes 403, 404 formed on the hinged ends of the first and second clip members 10, 12 respectively. Enlarged heads 405 may be provided on upper and lower ends of each pin 401, 402 for securely holding the first and second pins 401, 402 in the first and second pin holes 403, 404.

A top hinge member 406 formed with first and second openings 408 may be mounted on the upper ends of the first and second pins 401, 401 respectively, and secured thereto by the enlarged heads 405. A bottom hinge member 407 formed with first and second openings 409 may be mounted on the lower ends of the first and second pins 401, 402 respectively, and secured thereto by the enlarged heads 405.

Although it has been shown and described that the hinge includes two pins and two hinge plates for hingedly connected the first and second clip members, it is understood by one skilled in the art that the two clip members can be hingedly connected together by any other possible hinge.

Figure 11:
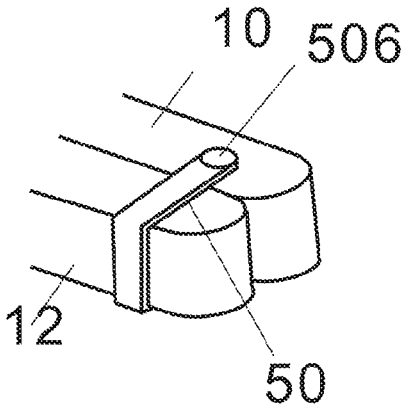
FIG. 11 is a fragmentary view of an embodiment of a fastener of the bendable and shape-retaining hair cutting apparatus.
Figure 12:
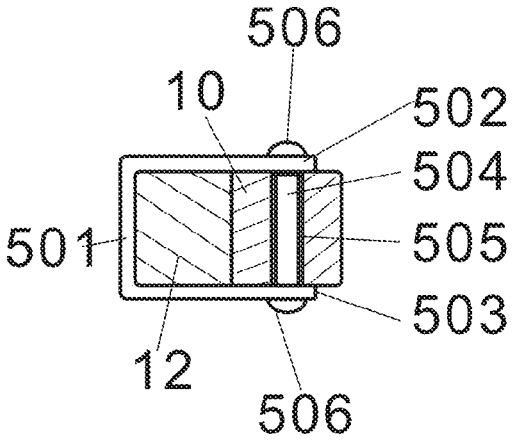
FIG. 12 is a cross sectional view of the fastener of FIG. 11.

FIGS. 11 and 12 show an embodiment of the fastener 50 of the bendable and shape-retaining hair cutting apparatus. The fastener 50 may include a U-shaped strap having a U-shaped body 501 and two ends 502, 503, each end being formed with an opening 507. A third pin 504 may be inserted into a third pin hole 505 formed on the opposite free end of the first clip member 10. The two openings 507 of the two ends 502, 503 of the U-shaped body 501 may be mounted on upper and lower ends of the third pin 504 and secured thereto by two enlarged heads 506 formed thereon respectively. The U-shaped body 501 is adapted to be swung about the third pin 504 and wrapped tightly around the opposite free end of the second clip member 12 to thereby fasten the first and second clip members 10, 12 side-by-side together.

Although it has been shown and described that the fastener of the bendable and shape-retaining hair cutting apparatus is in the form of a swinging U-shaped strap, it is understood by one skilled in the art that any appropriate fastener such as snap fastener and clip, etc. can be used.

Figure 13:
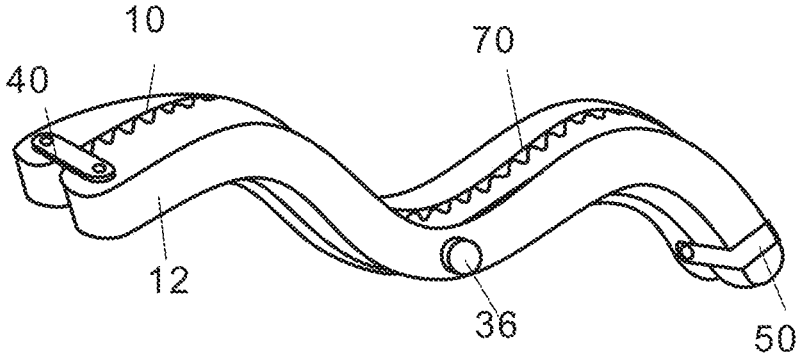
FIG. 13 is a perspective view of the bendable and shape-retaining hair cutting apparatus being bent into a wavy shape.
Figure 13A:
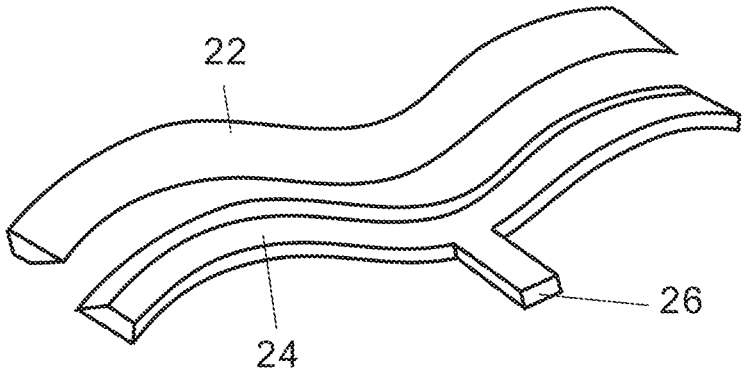

FIG. 13 shows the bendable and shape-retaining hair cutting apparatus being bent into a wavy shape for the creation of a wavy cut of the hair on the back of a head, as illustrated in FIG. 7(*g*). Corrugated surface 70 may be formed on the inner side 20 of the second clip member 12.

FIG. 13(*a*) is a perspective view of the two blades 22, 24 of the bendable and shape-retaining hair cutting apparatus being bent into a wavy shape.

Figure 14:
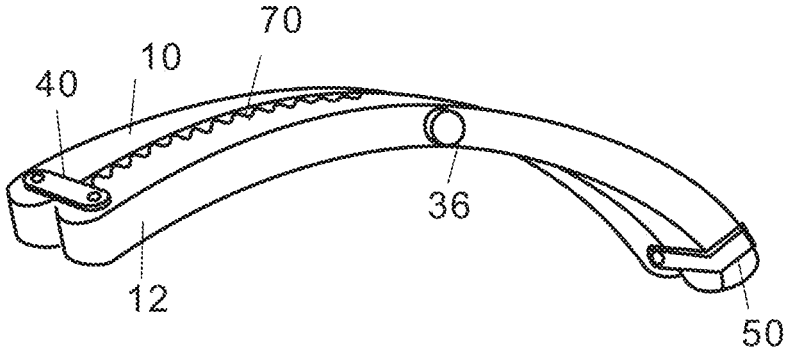
FIG. 14 is a perspective view of the bendable and shape-retaining hair cutting apparatus being bent into a downwardly curved shape.
Figure 14A:
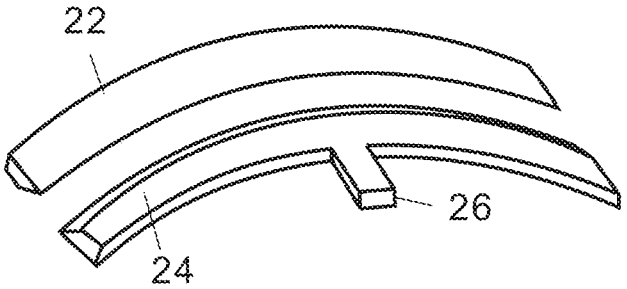

FIG. 14 shows the bendable and shape-retaining hair cutting apparatus being bent into a downwardly curved shape for the creation of a downwardly curved bangs cut of the hair above the forehead, as illustrated in FIG. 7(*d*), or a "pageboy cut" of the hair on the side of a head, as illustrated in FIG. 7(*k*).

FIG. 14(*a*) is a perspective view of the two blades 22, 24 of the bendable and shape-retaining hair cutting apparatus being bent into a downwardly curved shape.

Figure 15:
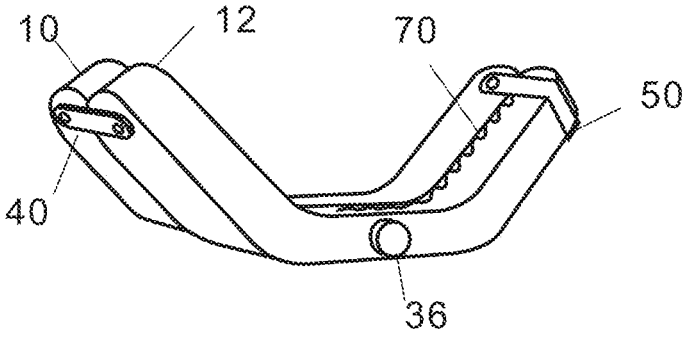
FIG. 15 is a perspective view of the bendable and shape-retaining hair cutting apparatus being bent into a generally U-shape.
Figure 15A:
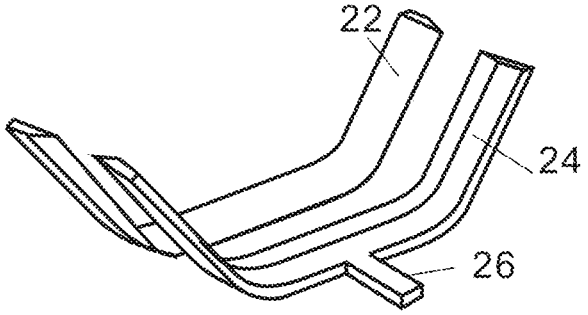

FIG. 15 shows the bendable and shape-retaining hair cutting apparatus being bent into a generally U-shape for the creation of a generally U-shaped cut of the hair at the nape area at the back of a head, as illustrated in FIG. 7(*e*).

FIG. 15(*a*) is a perspective view of the two blades 22, 24 of the bendable and shape-retaining hair cutting apparatus being bent into a generally U-shape.

Figure 16:
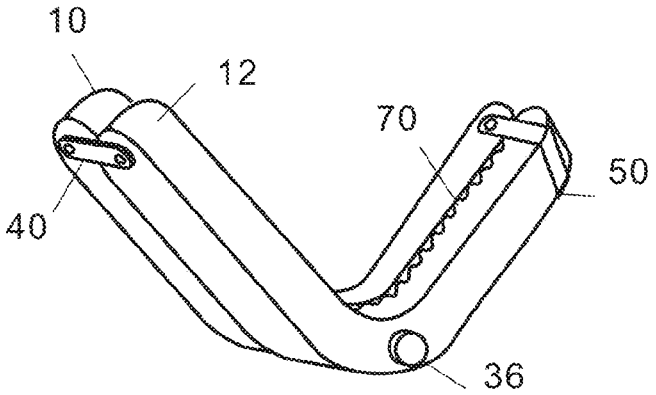
FIG. 16 is a perspective view of the bendable and shape-retaining hair cutting apparatus being bent into a V-shape.
Figure 16A:
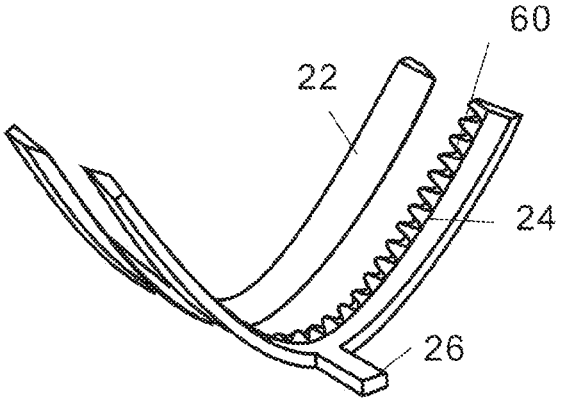

FIG. 16 shows the bendable and shape-retaining hair cutting apparatus being bent into a V-shape for the creation of a V-shaped cut of the hair on the back of a head, as illustrated in FIG. 7(*h*).

FIG. 16(*a*) is a perspective view of the two blades 22, 24 of the bendable and shape-retaining hair cutting apparatus being bent into a V-shape. The blade 24 may be formed with a plurality of teeth 60.

Figure 17:
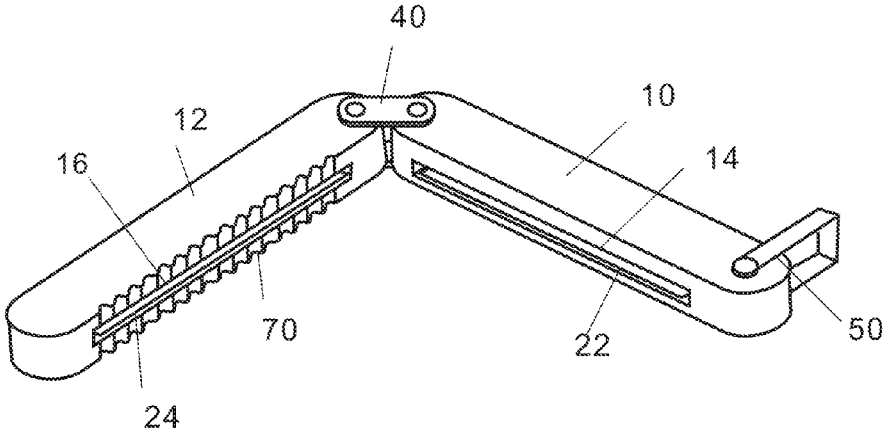
FIG. 17 is a perspective view of the bendable and shape-retaining hair cutting apparatus with the two clip members in an opened position.

FIG. 17 shows the bendable and shape-retaining hair cutting apparatus with the first and second clip members 10, 12 in an opened position. Corrugated surface 70 may be formed on the inner side of the second clip member 12.

Figure 18:
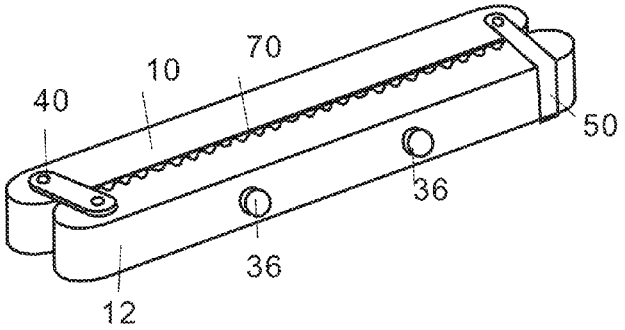
FIG. 18 is a perspective view of another embodiment of the bendable and shape-retaining hair cutting apparatus having two push buttons.

FIG. 18 is a perspective view of another embodiment of the bendable and shape-retaining hair cutting apparatus with two push buttons 36. A user may use both hands to push the buttons 36 to cut the hair.

Figure 19:
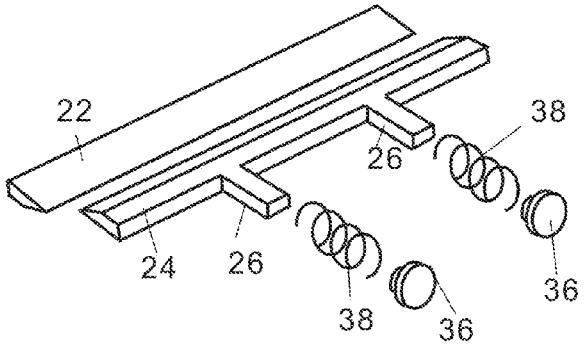
FIG. 19 is a perspective view of the two blades of the bendable and shape-retaining hair cutting apparatus of FIG. 18.

FIG. 19 is a perspective view of the two blades 22, 24 of the bendable and shape-retaining hair cutting apparatus of FIG. 18.

While the hair cutting apparatus has been shown and described with particular references to a number of preferred embodiments thereof, it should be noted that various other changes or modifications may be made without departing from the scope of the appended claims.

What is claimed is:

1. A bendable and shape-retaining hair cutting apparatus comprising:

first and second resilient clip members (10, 12) hingedly connected to each other, and provided with oppositely facing first and second grooves (14, 16) formed on opposite inner sides (18, 20) of the first and second clip members (10, 12) respectively;

a first blade (22) fixedly mounted in the first groove (14);

a second blade (24) moveably mounted in the second groove (16), and adapted to be inserted into the first groove (14) and entered into slidable and shearing engagement with the first blade (22), the first and second blades (22, 24) being made of bendable and shape-retaining metal or alloy;

a push plate (26) extending transversely from an inner lateral side (28) of the second blade (24) and passing through a transverse bore (30) formed on an outer side (32) of the second clip member, a free end of the push plate (26) being protruded from the outer side (32) of the second clip member;

a push button (36) fixed at the free end of the push plate (26); and a spring (38) mounted on the push plate (26) between the second blade (24) and the push button (36) for biasing the second blade (24) in a retracted position inside the second groove (16);

wherein the first and second clip members (10, 12) together with the first and second blades (22, 24) provided therein are adapted to be bent into a plurality of desired shapes; and when the push button (36) is pushed against the spring (38), the second blade (24) moves laterally towards the first blade (22) and enters into slidable and shearing engagement therewith, thereby cutting hair clipped between the first and second clip members (10, 12) and creating a plurality of haircuts of the desired shapes.

2. The apparatus as claimed in claim 1, wherein a hinged end of the first clip member (10) is hingedly connected with a hinged end of the second clip member by a hinge (40), and an opposite free end of the first clip member (10) is adapted to be fastened to an opposite free end of the second clip member by a fastener (50).

3. The apparatus as claimed in claim 2, wherein the hinge (40) comprises:

first and second pins (401, 402) inserted into first and second pin holes (403, 404) formed on the hinged ends of the first and second clip members (10, 12) respectively, enlarged heads (405) being provided on upper and lower ends of each pin for securely holding the first and second pins (401, 402) in the first and second pin holes (403, 404);

a top hinge member (406) formed with first and second openings (408) mounted on the upper ends of the first and second pins (401, 402) respectively, and secured thereto by the enlarged heads (405); and a bottom hinge member (407) formed with first and second openings (409) mounted on the lower ends of the first and second pins (401, 402) respectively, and secured thereto by the enlarged heads (405).

4. The apparatus as claimed in claim 1, wherein the second blade (24) is in the form of a toothed blade with a plurality of teeth adapted to be inserted into the first groove (14) and entered into slidable and shearing engagement with the first blade (22) when the first and second clip members (10, 12) are fastened together.

5. The apparatus as claimed in claim 2, wherein the fastener (50) comprises:

a U-shaped strap having a U-shaped body (501) and two ends (502, 503), each end being formed with an opening (507); and a third pin (504) inserted into a third pin hole (505) formed on the opposite free end of the first clip member (10), the two openings (507) of the two ends (502, 503) of the U-shaped strap being mounted on upper and lower ends of the third pin (504) and secured thereto by two enlarged heads (506) formed thereon respectively;

wherein the U-shaped body (501) is adapted to be swung about the third pin (504) and wrapped around the opposite free end of the second clip member to thereby fasten the first and second clip members (10, 12) side-by-side together.

6. The apparatus as claimed in claim 1, wherein at least one of the two opposite inner sides (18, 20) of the first and second clip members (10, 12) is a corrugated surface (70).

7. The apparatus as claimed in claim 1, wherein the bendable and shape-retaining metal or alloy is selected from the group consisting of copper, copper alloy, aluminum, aluminum alloy, and combinations thereof.

8. The apparatus as claimed in claim 1, wherein the first and second clip members (10, 12) are made of a shape-retaining plastic material selected from the group consisting of polyethylene, polyurethane, polystyrene, and combinations thereof.

9. The apparatus as claimed in claim 1, wherein one of the desired shapes is a straight shape for producing a straight haircut.

10. The apparatus as claimed in claim 1, wherein one of the desired shapes is an upwardly curved shape for producing an upwardly curved haircut.

11. The apparatus as claimed in claim 1, wherein one of the desired shapes is a downwardly curved shape for producing a downwardly curved haircut.

12. The apparatus as claimed in claim 1, wherein one of the desired shapes is a generally U-shape for producing a generally U-shaped haircut.

13. The apparatus as claimed in claim 1, wherein one of the desired shapes is a V-shape for producing a V-shaped haircut.

14. The apparatus as claimed in claim 1, wherein one of the desired shapes is a wavy shape for producing a wavy haircut.

15. The apparatus as claimed in claim 1, comprising two push plates (26) extending transversely from the inner lateral side (28) of the second blade (24) and passing through two transverse bores (30) formed on the outer side (32) of the second clip member respectively, a free end of each push plate (26) being protruded from the outer side (32) of the second clip member;

two push buttons (36) fixed at the free ends of the two push plates (26) respectively; and two springs (38) mounted on the two push plates (26) between the second blade (24) and the two push buttons (36) respectively for biasing the second blade (24) in the retracted position inside the second groove (16).

16. A bendable and shape-retaining hair cutting apparatus comprising:

first and second resilient clip members (10, 12) hingedly connected to each other, and provided with oppositely facing first and second grooves (14, 16) formed on opposite inner sides (18, 20) of the first and second clip members (10, 12) respectively;

a first blade (22) fixedly mounted in the first groove (14);

a second blade (24) moveably mounted in the second groove (16), and adapted to be inserted into the first groove (14) and entered into slidable and shearing engagement with the first blade (22), the first and second blades (22, 24) being made of bendable and shape-retaining metal or alloy;

a push plate (26) extending transversely from an inner lateral side (28) of the second blade (24) and passing through a transverse bore (30) formed on an outer side (32) of the second clip member (12), a free end of the push plate (26) being protruded from the outer side (32) of the second clip member (12);

a push button (36) fixed at the free end of the push plate (26);

a spring (38) mounted on the push plate (26) between the second blade (24) and the push button (36) for biasing the second blade (24) in a retracted position inside the second groove (16);

a hinge (40) connecting a hinged end of the first clip member (10) with a hinged end of the second clip member (12); and a fastener (50) adapted to fasten an opposite free end of the first clip member (10) to an opposite free end of the second clip member (12);

wherein the first and second clip members (10, 12) together with the first and second blades (22, 24) provided therein are adapted to be bent into a plurality of desired shapes;

and when the push button (36) is pushed against the spring (38), the second blade (24) moves laterally towards the first blade (22) and enters into slidable and shearing engagement therewith, thereby cutting hair clipped between the first and second clip members (10, 12) and creating a plurality of haircuts of the desired shapes;

wherein the hinge (40) comprises:

first and second pins (401, 402) inserted into first and second pin holes (403, 404) formed on the hinged ends of the first and second clip members (10, 12) respectively, enlarged heads (405) being provided on upper and lower ends of each pin for securely holding the first and second pins (401, 402) in the first and second pin holes (403, 404);

a top hinge member (406) formed with first and second openings (408) mounted on the upper ends of the first and second pins (401, 402) respectively, and secured thereto by the enlarged heads (405); and a bottom hinge member (407) formed with first and second openings (409) mounted on the lower ends of the first and second pins (401, 402) respectively, and secured thereto by the enlarged heads (405);

wherein the fastener (50) comprises:

a U-shaped strap having a U-shaped body (501) and two ends (502, 503), each end being formed with an opening (507); and a third pin (504) inserted into a third pin hole (505) formed on the opposite free end of the first clip member (10), the two openings of the two ends (502, 503) of the U-shaped strap being mounted on upper and lower ends of the third pin (504) and secured thereto by two enlarged heads (506) formed thereon respectively;

wherein the U-shaped body (501) is adapted to be swung about the third pin (504) and wrapped around the opposite free end of the second clip member (12) to thereby fasten the first and second clip members (10, 12) side-by-side together.

17. The apparatus as claimed in claim 16, wherein the second blade (24) is in the form of a toothed blade with a plurality of teeth adapted to be inserted into the first groove (14) and entered into slidable and shearing engagement with the first blade (22) when the first and second clip members (10, 12) are fastened together.

18. The apparatus as claimed in claim 16, wherein at least one of the two opposite inner sides (18, 20) of the first and second clip members (10, 12) has a corrugated surface (70).

19. The apparatus as claimed in claim 16, wherein the bendable and shape-retaining metal or alloy is selected from the group consisting of copper, copper alloy, aluminum, aluminum alloy, and combinations thereof.

20. The apparatus as claimed in claim 16, wherein the first and second clip members (10, 12) are made of a shape-retaining plastic material selected from the group consisting of polyethylene, polyurethane, polystyrene, and combinations thereof.

* * * * *